US008366395B1

(12) United States Patent
Liang

(10) Patent No.: US 8,366,395 B1
(45) Date of Patent: Feb. 5, 2013

(54) TURBINE BLADE WITH COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 373 days.

(21) Appl. No.: 12/909,421

(22) Filed: Oct. 21, 2010

(51) Int. Cl.
*F01D 5/16* (2006.01)

(52) U.S. Cl. ..... 416/97 R; 416/96 R

(58) Field of Classification Search ..... 416/96 R, 416/97 R
See application file for complete search history.

(56) References Cited

U.S. PATENT DOCUMENTS 5,702,232 A * 12/1997 Moore ..... 416/95
7,530,789 B1 * 5/2009 Liang ..... 416/97 R

* cited by examiner

*Primary Examiner* — Dwayne J White
(74) *Attorney, Agent, or Firm* — John Ryznic

(57) ABSTRACT

A turbine blade with individual metering and impingement cooling modules spaced around four zones of the airfoil designed to provide local blade cooling based on the heat load as well as tailoring the local pressure distribution to optimize film cooling. Each metering and impingement module is fluidly separated from others.

6 Claims, 2 Drawing Sheets

TURBINE BLADE WITH COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with multiple zone cooling based on airfoil gas side pressure and heat load.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A single turbine rotor blade with be exposed to different gas flow temperatures and pressures around the surfaces. For example, the leading edge is exposed to the highest gas flow pressures and temperatures. The airfoil trailing edge on the suction side is exposed to the lowest gas flow pressures. In order to cool the blade more efficiency and to prevent certain surfaces from over-heating, tailoring the cooling throughout the blade is needed. Hot spots cause erosion of the blade surface that decreases turbine efficiency and shortens the useful life of the blade. Excessive cooling air flow will decrease engine efficiency from the extra work done on compressing the cooling air that is not needed for cooling.

BRIEF SUMMARY OF THE INVENTION

A turbine rotor blade with a cooling circuit that includes multiple zones based on the airfoil gas side pressure and heat load. Multiple metering and impingement cooling modules are used for each airfoil zone. The airfoil is subdivided into a leading edge zone, a pressure side zone, multiple suction side zones, and a trailing edge zone. Each zone includes a cooling air supply channel followed by one ore two impingement cavities in which each impingement cavity include a row of film cooling holes or exit holes to discharge the cooling air. The impingement holes are directed to discharge impingement cooling air onto a backside surface of a hot wall section of the airfoil. Metering holes are used on the inlets of each cooling air supply cavity to control the pressure and flow rate for the individual modules.

DETAILED DESCRIPTION OF THE INVENTION

Figure 1:
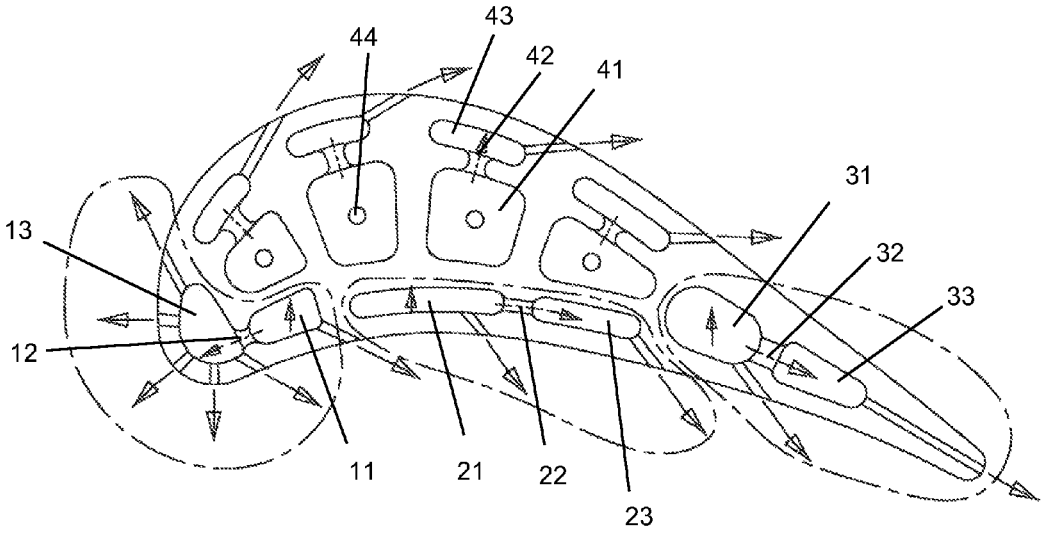
FIG. 1 shows a cross section view of the turbine blade of the present invention with individual cooling modules for each of the zones of the airfoil.

A turbine rotor blade with multiple metering and impingement cooling. Individual impingement and cooling modules are used for each different section or zone of the airfoil which is designed to provide local blade cooling based on the heat load and the local pressure distribution in order to optimize the film cooling and maximize the use of the cooling air. FIG. 1 shows the airfoil with four separate zones with cooling modules.

Due to a high heat load and a high gas side pressure in the airfoil leading edge zone, a single cooling flow circuit is used here. Cooling air is supplied through a radial cooling air supply channel 11 and then metered through a row of impingement cooling holes 12 to produce impingement cooling on the backside surface of the airfoil leading edge impingement cavity 13. The spent cooling air is then discharged through a series of film cooling holes that form a showerhead arrangement with gill holes on the suction side and the pressure side of the leading edge region.

In the airfoil pressure side zone, the forward region has a high gas side pressure that decreases along the airfoil toward the trailing edge region. The heat load in this zone is low at the forward end and increases toward the trailing edge region. For the airfoil pressure side zone, a parallel multiple metering and impingement cooling system is used. Cooling air is supplied through a first pressure side radial flow cooling air supply channel 21 which is then metered through a row of impingement cooling holes 22 and onto a partition rib of a second radial flow channel 23 to generate a side wall impingement cooling. Cooling air from a blade external source is supplied only to the cooling supply channel 21. Cooling air for the second radial channel 23 is supplied through the row of impingement holes 22. A row of film cooling holes is connected to both of the radial flow channels 21 and 23 to provide pressure side wall film cooling.

In the airfoil trailing edge zone, a similar cooling system to the pressure side system is used. Cooling air is supplied through a first trailing edge radial flow cooling air supply channel 31 and then metered through a row of impingement cooling holes 32 to discharge impingement cooling air onto a partition rib of a second radial flow channel 33 to generate a side wall impingement cooling. Cooling air from a blade external source is supplied only to the cooling supply channel 31. Cooling air for the second radial channel 33 is supplied through the row of impingement holes 32. Film cooling holes connected to the first radial flow cooling supply channel 31 discharge film cooling air onto the pressure side wall and a row of exit cooling holes or slots are connected to the second radial flow channel 33 to discharge the spent cooling air.

On the airfoil suction side zone, due to various high heat load and gas side pressure distribution along the suction side airfoil surface, a multiple metering and impingement cooling flow system is used. Cooling air is supplied through a middle coolant supply channel 41, flows through a row of metering holes 42, and then impinged onto the airfoil suction side cavity 43. The cooling air is metered for each individual cooling supply channel by an inlet metering hole 44. Cooling pressure level for each individual suction side impingement cavity 43 is regulated by the impingement metering holes 42. The multiple metering and impingement modules can be constructed along the airfoil chordwise length as well as along the airfoil spanwise length depending on the cooling requirements. The spent cooling air is discharged from the suction side impingement cavities 43 through film cooling holes onto the airfoil external wall to provide film cooling.

Figure 2:
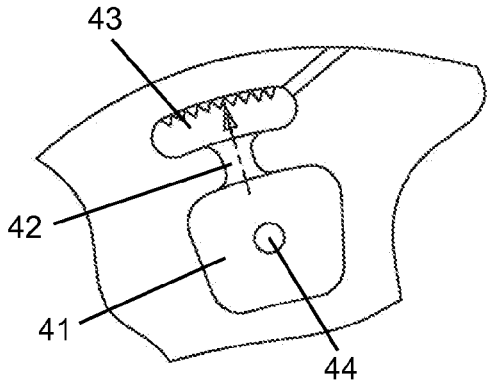
FIG. 2 shows a cross section top view of a metering and impingement module used on the suction side wall.
Figure 3:
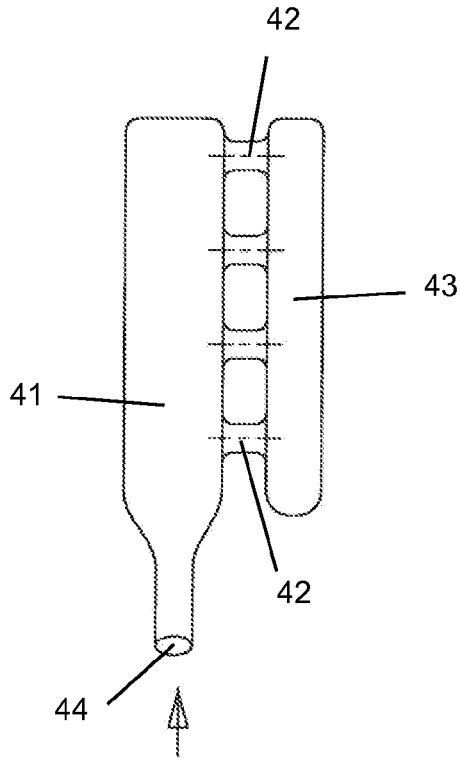
FIG. 3 shows a cross section side view of the metering and impingement module of FIG. 2.

FIG. 2 shows a close-up view of one of the metering and impingement modules used along the suction side wall zone. The cooling air is metered into the cooling supply channel 41 through an inlet metering hole 44, and then passes through a row of metering holes 42 and into the impingement cavity 43 located along the suction side wall to produce impingement cooling. A roughened surface can be formed on the hot side of the channel 43 to enhance the heat transfer effect. A row of film cooling holes then discharge the spent impingement cooling air. FIG. 3 shows a side view of the suction side cooling module of FIG. 2 with the row of metering holes 42 connecting the cooling supply channel 41 to the impingement channel 43.

The modular cooling circuits of the present invention can achieve a balanced cooling design tailored to the gas side pressure and heat load, is less sensitive to airfoil core size, and achieves a very high internal heat transfer coefficient for a given cooling supply pressure and flow amount.

I claim the following:

1. A turbine rotor blade comprising:

an airfoil with a leading edge zone, a trailing edge zone, a pressure side zone and a suction side zone;

the leading edge zone includes a cooling supply channel connected to a leading edge impingement cavity through a row of metering and impingement holes, and the leading edge impingement cavity is connected to a showerhead arrangement of film cooling holes;

the pressure side zone includes a first radial flow cooling supply channel connected to a second radial flow cooling through a row of metering and impingement holes, a first row of film cooling holes connected to the second radial flow cooling channel;

the trailing edge zone includes a first radial flow cooling supply channel connected to a second radial flow cooling channel, and a row of exit cooling holes connected to the second radial flow channel and opening onto the trailing edge of the airfoil;

the suction side zone includes a plurality of cooling supply channels connected to an impingement cavity through a row of metering and impingement holes, a row of film cooling holes connected to each of the impingement cavities, and the cooling supply channels and impingement cavities being separated from each other such that cooling air does not mix; and, each of the four zones being fluidly separated from each other such that cooling air does not mix.

2. The turbine rotor blade of claim 1, and further comprising:

the cooling supply channels for the suction side zone each include an inlet metering hole.

3. The turbine rotor blade of claim 1, and further comprising:

the cooling supply channel in the leading edge zone is located along the pressure side wall.

4. The turbine rotor blade of claim 3, and further comprising:

a row of film cooling holes connected to the cooling supply channel in the leading edge zone.

5. The turbine rotor blade of claim 1, and further comprising:

a second row of film cooling holes connected to the first radial flow cooling channel in the pressure side zone.

6. The turbine rotor blade of claim 1, and further comprising:

a row of film cooling holes connected to the first radial flow channel and opening onto the pressure side wall in the trailing edge zone.

* * * * *